United States Patent [19]

Troncoso, Jr.

[11] Patent Number: 4,748,964

[45] Date of Patent: Jun. 7, 1988

[54] ARCHERY BOW ARROW REST AND SIDE PRESSURE PLATE ASSEMBLY

[76] Inventor: Fernando Troncoso, Jr., 14090-6100 Rd., Montrose, Colo. 81401

[21] Appl. No.: 27,944

[22] Filed: Mar. 19, 1987

[51] Int. Cl.[4] ..... F41D 10/00; F41B 15/00

[52] U.S. Cl. ..... 124/41 A; 124/24 R

[58] Field of Search ..... 124/41 A, 24 R, 88, 124/86

[56] References Cited

U.S. PATENT DOCUMENTS

| | | | |
|---|---|---|---|
| 3,672,347 | 6/1972 | Allen | 124/41 A |
| 3,865,096 | 2/1975 | Troncoso, Jr. | 124/24 R |
| 3,935,854 | 2/1976 | Troncoso, Jr. | 124/24 R |
| 4,170,980 | 10/1979 | Killian | 124/41 A |
| 4,236,497 | 12/1980 | Troncoso, Jr. | 124/24 R |
| 4,332,232 | 6/1982 | Troncoso, Jr. | 124/24 R |
| 4,398,528 | 8/1983 | Troncoso, Jr. | 124/24 R |
| 4,476,846 | 10/1984 | Carville | 124/41 A |
| 4,489,704 | 12/1984 | Troncoso, Jr. | 124/24 R |
| 4,676,220 | 6/1987 | Pietraszek | 124/41 A |

*Primary Examiner*—Richard C. Pinkham
*Assistant Examiner*—Gary Jackson
*Attorney, Agent, or Firm*—Donald E. Nist

[57] ABSTRACT

The archery bow arrow rest and side pressure plate assembly includes an arrow rest formed of an elongated mounting block, a rear transverse cross bar adjustably connected thereto and a forwardly and upwardly extending resilient flexible arrow support connected to the free end of the crossbar. The side pressure plate sub-assembly includes a cross shaft adjustably threaded transversely through the block in front of the crossbar and bearing on its free end a flexible, resilient bent pressure plate having a pair of sloped surfaces joined at a laterally extending point and contactable with the side of an arrow shaft. The pressure plate may be V- or U-shaped and backed by a tensioning plate. It may be received in a close fitting slot in the free end of the cross shaft so that it will not inadvertantly pivot. The arrow support may also be backed by a tensioning plate. The pressure plate may include a long arm so that it extends well forward or rearward of the cross shaft for improved arrow clearance. The arrow support and pressure plate may have sloped sides facing each other to cradle an arrow shaft against rolloff from the rest. The assembly is simple, inexpensive and efficient.

7 Claims, 2 Drawing Sheets

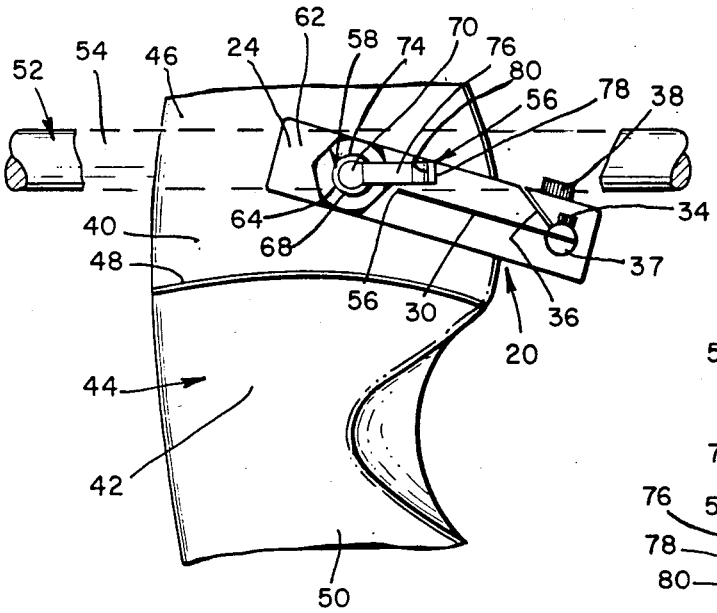
Fig. 1.
Fig. 2.
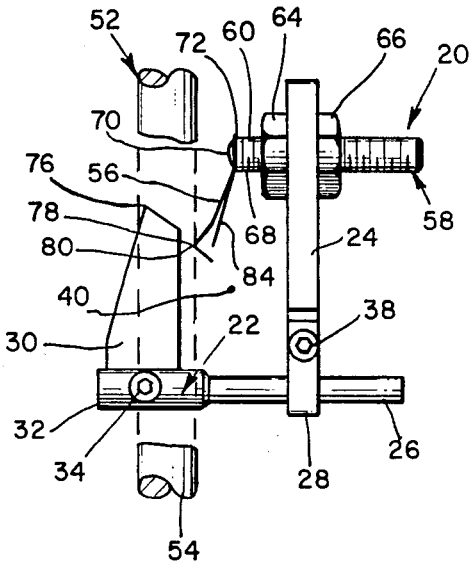
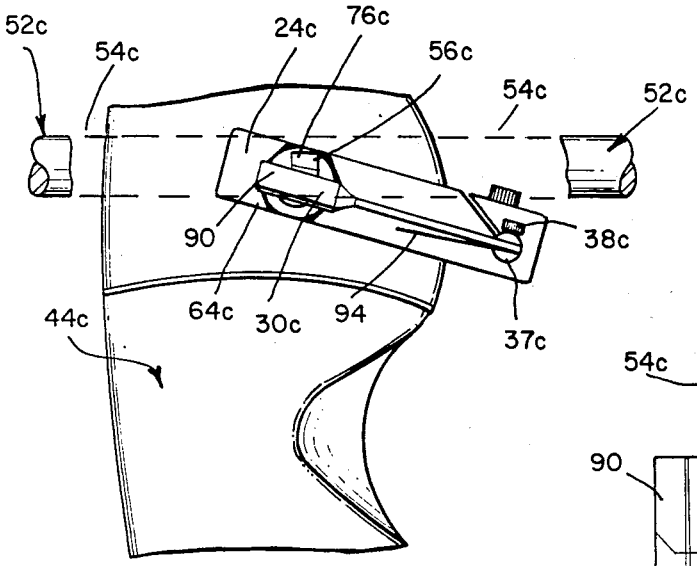
Fig. 3.
Fig. 4.
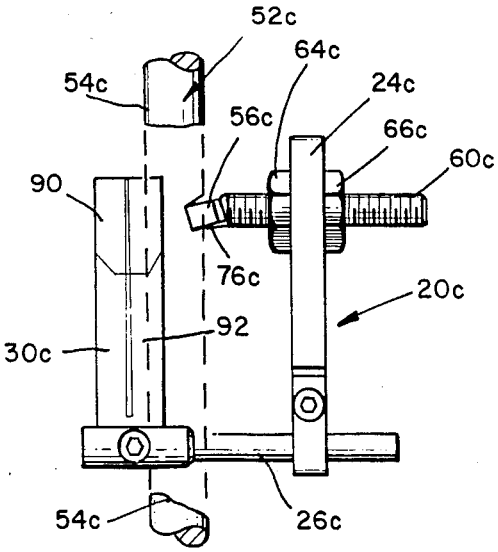

ARCHERY BOW ARROW REST AND SIDE PRESSURE PLATE ASSEMBLY

BACKGROUND OF THE INVENTION

1. Field of the Invention

The present invention generally relates to archery equipment and more particularly to an improved archery arrow rest and side pressure plate assembly.

2. Prior Art

Conventional arrow rests generally comprise a ledge or arm extending out into the arrow window defined by the archery bow riser sidewall and shelf above the handle and through which the arrow passes when shot from the bow. The arrow shaft while on the arrow rest is usually held away from the riser sidewall by a cushion plunger such as is illustrated in a number of U.S. patents, including U.S. Pat. Nos. 3,935,854; 4,236,497; 3,865,096; 4,398,528; 4,489,704 and 4,332,232.

The cushion plunger is usually a hollow rod threaded transversely through the riser and extending into the window, with a blunt tip slideably received therein and biased outwardly therefrom by an internal coil spring. When the arow is shot, the S-curve (archers' paradox) it normally assumes as it bends from the sudden bowstring force applied to its rear end is diminished by the cushion plunger, the plunger absorbing some of the arrow shaft's side thrust. Archers' paradox, before the advent of the cushion plunger, was thought to be desirable so as to allow the fletched rear end of the arrow to bend sufficiently far so as to clear the bow and rest without striking them. The cushion plunger, by reducing S-curving of the arrow on its way to the target, increased the risk of the arrow hitting the rest or riser sidewall and careening off-line. Moreover, the cushion plunger characteristically intersects the arrow shaft at a right angle, just where the rest is also holding the arrow and therefore narrows the clearance space in the window for the arrow. It also puts considerable drag on the arrow. Although cushion plungers improve arrow performance in some respects, they leave other problems unresolved.

Accordingly, there is a need for a new and improved arrow rest and side pressure plate assembly which will hold the arrow in place, preferably to prevent roll-off of the arrow while the bow is being transported, a common problem with most conventional arrow rests, and which will also increase the clearance of the arrow from the rest, side pressure plate and riser sidewall, while improving the speed and accuracy of the arrow flight and minimizing arrow wear.

SUMMARY OF THE INVENTION

The improved archery bow arrow rest and side pressure plate assembly of the present invention satisfies the foregoing needs. The assembly is substantially as set forth in the Abstract. Thus, it includes an arrow rest in the form of a rearwardly extending block, a rear transverse adjustable cross bar connected thereto and a resilient, flexible blade or inverted V-shaped arrow support connected to the free end of the crossbar and adapted to project forwardly and upwardly into an arrow window on a bow. The block is connected to the bow's riser sidewall and the cross bar is behind the riser. The arrow support may have a tensioning blade under it.

The assembly also includes a side plate sub-assembly in the form of a cross shaft adjustably threaded transversely through the front end of the block for connecting the block to the riser sidewall, and extending into the window. The sub-assembly also includes a flexible, resilient bent pressure plate in the form of a V or U, when viewed from above, and having sloped sides and a point directed toward the arrow rest. Preferably, the pressure plate is backed by a tensioning or biasing plate and has one long arm or side which extends it forwardly or rearwardly of the arrow rest's arrow contact area to improve arrow clearance.

In one embodiment, the arrow support and pressure plate have adjoining sloped sides which cradle the arrow against arrow roll-off from the rest. The pressure plate is positively locked in place against inadvertant pivoting but can be rotated to any desired angle of inclination to minimize frictional contact and maximize arrow clearance. It increases archer's paradox over that provided by the cushion plunger, thus improving arrow flight clearance and shooting accuracy while reducing wear on the arrow, rest and pressure plate. The assembly is simple, inexpensive, durable and efficient.

Other features of the improved assembly are set forth in the drawings and following detailed description.

DRAWINGS

FIG. 1 is a schematic side elevation of a first preferred embodiment of the improved assembly of the present invention, shown mounted on the riser of an archery bow;

FIG. 2 is a schematic top plan view of the assembly of FIG. 1;

FIG. 3 is a schematic side elevation of a second preferred embodiment of the improved assembly of the present invention, shown mounted on the riser of an archery bow;

FIG. 4 is a schematic top plan view of the assembly of FIG. 3;

DETAILED DESCRIPTION

Figure 5:
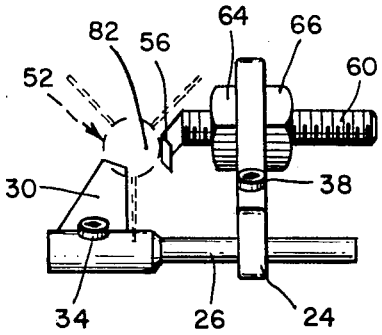
FIG. 5 is a schematic rear elevation of the assembly of FIG. 1.

FIGS. 1, 2, 5, 7 and 8

A first preferred embodiment of the improved assembly of the present invention is schematically depicted in FIGS. 1, 2, 5, 7 and 8. Thus, in FIG. 1 assembly 20 is shown which comprises an arrow rest 22 formed of a rectangular block 24 of metal, plastic, or the like, a metal or plastic cross-bar 26 extending transversely through the rear end 28 of block 24 and a flexible resilient metal or plastic arrow support blade 30 releasably connected to the free end 32 of cross-bar 26, as by a threaded screw 34.

As can be seen in FIG. 1, block 24 may bear a diagonaled transverse slot 36 leading to a transverse hole 37 therein. Screw 38 passes down through slot 36 to realeasably clamp cross-bar in hole 37 to adjust the position of blade 30 laterally of block 24 and thus in arrow window 40 into which blade 30 extends upwardly and forwardly.

Window 40 is defined in the riser 42 of bow 44 by riser sidewall 46 and arrow shelf 48 above handle 50 (FIG. 1). It is through window 40 that arrow 52 passes when shot by bow 44.

Shaft 54 of arrow 52 is supported horizontally in window 40 by the upwardly extending forward end 55 of blade 30, while it also contacts side pressure plate 56 of sub-assembly 58 which spaces it from sidewall 46. Sub-assembly 58 also includes a threaded screw or bolt 60 extending transversely through the front end 62 of block 24 and through sidewall 46 and releasably locked thereto by nuts 64 and 66.

The end 68 of bolt 60 which extends into window 40 has a round headed screw 70 threaded thereinto. Screw 70 releasably traps a parallel sided part 72 of plate 56 in a closely fitting rectangular slot 74 in end 68 so that plate 56 cannot shift position or pivot unless screw 70 is entirely removed. However, the angle of inclination of plate 56 can be changed merely by loosening nuts 64 and 66 and rotating bolt 60.

It will be noted that plate 56 is flexible, resilient and bent, with two sloped sides 76 and 78 joined at a point 80 facing blade 30 but spaced above and laterally thereof to provide a wide space or lane 82 (FIG. 5) through or around which arrow 52 can pass. Moreover, side 76 is elongated so that plate 56 extends well behind the front end 55 of blade 30, increasing lane 82. Plate 56 can be rotated to the forward position with similar results. For the sake of clarity, FIGS. 2 and 5 do not depict assembly 20 in place on bow 44. Either of sides 76 and 78 or point 80 can be used at any desired inclination angle to contact shaft 54 with minimal frictional contact and optimal arrow flight results.

Figure 6:
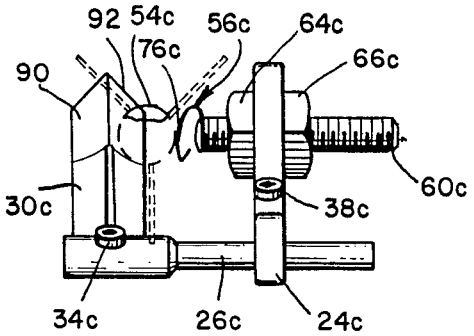
FIG. 6 is a schematic rear elevation of the assembly of FIG. 3.
Figure 7:
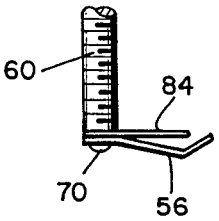
FIG. 7 is an enlarged schematic top plan view of the side pressure plate of FIG. 1 in a relatively more flexible position.
Figure 8:
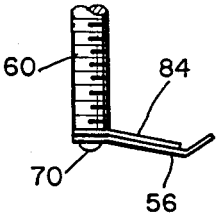
FIG. 8 is an enlarged schematic top plan view of the side pressure plate of FIG. 1 in a relatively less flexible position.

Plate 56 is backed by a flat spring tensioning or biasing metal or plastic plate 84 which is flexible, resilient, bendable and shown in FIGS. 2, 6 and 7. Plate 84 can be connected to bolt 60 by screw 70. In FIG. 7, plate 84 is shown spaced well behind plate 56, which is V-shaped in top plan view. In this position, plate 56 will flex toward sidewall 46 relatively more easily than it will when plate 84 is bent into the position shown in FIG. 8 immediately behind plate 56. Thus, the amount of archer's paradox-reducing spring tension exerted by plate 56 against shaft 54 can be easily and rapidly controlled by plate 84 for optimum results and without changing plates 84 and 56. Accordingly, sub-assembly is fully and immediately adjustable through bolt 60, nuts 64 and 66, rotation of plate 56 and spacing of plate 84. Arrow rest 22 is similarly adjustable through rotation of block 24, lateral adjustment of crossbar 26 and rotation of blade 30 for optimal results. Assembly 20 is simple, inexpensive, durable and efficient.

Figure 9:
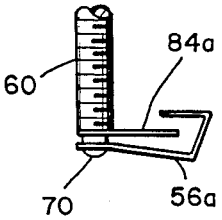
FIG. 9 is an enlarged schematic top plan view of a modified U-shaped version of the side pressure plate of the present assembly.
Figure 10:
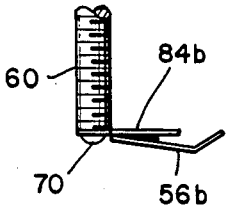
FIG. 10 is an enlarged schematic top plan view of a version in which the side pressure plate of the present assembly is spot-welded to a backing plate; and, FIG. 11 is a schematic rear elevation of the third preferred embodiment of the improved assembly of the present invention.

FIGS. 9 and 10

In FIG. 9, bolt 60 is shown with a modified plate 56*a* which is generally U-shaped in top plan view, while in FIG. 10 bolt 60 is shown with a plate 56*b* similar to plate 56 but spot welded to backing plate 84*b* instead of separately supported in bolt 60. The components depicted in FIGS. 9 and 10 are otherwise identical to those of FIGS. 7 and 8.

FIGS. 3, 4 and 6

A second preferred embodiment of the improved assembly of the present invention is schematically depicted in FIGS. 3, 4 and 6. Thus, assembly 20*c* is shown. Components thereof similar to those of assembly 20 bear the same numerals but are succeeded by the letter "c". Assembly 20*c* is identical to assembly 20 except for the following:

a. Screw 38*c* extends directly into hole 37*c*. There is no slot comparable to slot 36.

b. Blade 30*c* has two downwardly sloped sides 90 and 92 and is backed by a steel spring tension plate 94 to prevent sagging.

c. Plate 56*c* has no tension plate behind it and is oriented differently than plate 56, with its side 76*c* directly opposite and sloping toward side 92 of blade 30*c* so as to form a trough therewith in which shaft 54*c* of arrow 52*c* is cradled to prevent it from rolling off rest 22*c* when bow 44*c* is being carried. Assembly 20*c* has the other advantages of assembly 20.

FIG. 11

Figure 11:
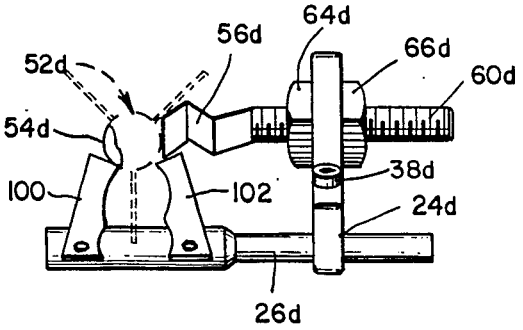

A third preferred embodiment of the invention is schematically depicted in FIG. 11. Thus, assembly 20*d* is shown. Components thereof similar to those of assembly 20 or 20*c* bear the same numerals but are succeeded by the letter "d". Assembly 20*d* differs from assembly 20 only in the following aspects:

Blade 30*d* is in the form of a spaced pair of forwardly and upwardly extending arms 100 and 102 secured to crossbar 26*d* without a screw 34 and contacting opposite sides of the underside of shaft 54*d* of arrow 52*d* to support it. Arrow 52*d* is centered on arms 100 and 102 for a true center shot arrangement.

Various other modifications, changes, alterations and additions can be made in the improved assembly of the present invention, its components and their parameters. All such modications, changes, alterations and additions are within the scope of the appended claims form part of the present invention.

Prior Art Statement

No search of the prior art has been conducted by Applicant. However, the following prior issued patents, a copy of each of which is enclosed, are the closest prior art known to Applicant:

U.S. Pat. Nos. 3,935,854, 4,236,497, 3,865,096, 4,398,528, 4,489,704, 4,332,232.

None of the above-listed patents anticipate or render the present claimed invention obvious. In each case, either no side pressure plate is shown, or one is shown which has a flat or rounded end pressing directly against an arrow shaft midline perpendicular to its longitudinal axis and next to the holding tip af a non-cradling arrow rest. In contrast thereto, the pressure side pressure plate of the present inventions utilizes its pointed end or one of its sloped sides to contact the arrow shaft, preferably well ahead or behind the point of contact of the arrow rest and is fully adjustable, for improved clearance.

What is claimed is:

1. An improved archery bow arrow rest and side pressure plate assembly comprising, in combination:

a. an arrow rest adapted to be mounted in an arrow window of an archery bow and having i. an elongated mounting block, ii. means for securing the front end of said block on a bow riser sidewall so that the rear end of said block will extend behind said riser, iii. a transverse cross bar releasably adjustably connected to said block adjacent the rear end thereof, adapted to extend behind a bow riser arrow window and bearing an upwardly and forwardly-extending, resilient flexible arrow support adapted to contact the underside of an arrow shaft while in said window; and b. an arrow side pressure plate sub-assembly connected to said block in front of said crossbar and adapted to contact the side of an arrow shaft while in said window, said sub-assembly including i. a cross shaft releasably adjustably connected at one end thereof to said block and having a free end, ii. a bent flexible resilient pressure plate having a pair of sloped surfaces joined at a laterally extending point facing said arrow support, at least one of said surfaces and said point being adapted to contact the side of an arrow shaft while in said arrow window, and iii. releasable locking means releasably securing said plate on the free end of said cross shaft, at any desired angle to said flexible arrow support, said arrow support having a side which slopes towards said bent plate and wherein said bent pressure plate has a side which slopes toward said sloped arrow support side to form therewith an arrow-retention cradle to prevent inadvertant arrow rolloff from said rest.

2. The improved assembly of claim 1 wherein said plate sub-assembly includes a reinforcing plate means adjustably spaced behind said bent pressure plate and connected to said free end of said cross shaft for adjustably tensioning said bent pressure plate.

3. The improved assembly of claim 2 wherein said bent pressure plate is generally V-shaped in top plan view.

4. The improved assembly of claim 3 wherein said bent pressure plate includes a long contact arm extending forwardly or rearwardly of said cross shaft for improved arrow clearance.

5. The improved assembly of claim 1 wherein said arrow rest includes a flexible tension plate means below and adjacent to said arrow support to control the extent of flexing thereof.

6. The improved assembly of claim 1 wherein said bent pressure plate has parallel side margins and wherein said free end of said cross-shaft includes a slot which is generally rectangular and dimensioned to hold said bent pressure plate without permitting pivoting of said bent plate therein.

7. The improved assembly of claim 6 wherein said bent pressure plate is spring steel, wherein said arrow support is metal or plastic, wherein said cross-shaft is threaded transversely through said block so as to be adjustable into said arrow window, wherein said crossbar is adjustably extendable to adjustably position said arrow support in said arrow window and wherein said block is pivotable on said cross shaft to change the angle of inclination of said block and arrow support.

* * * * *